US009848749B1

(12) United States Patent
Adams

(10) Patent No.: US 9,848,749 B1
(45) Date of Patent: Dec. 26, 2017

(54) CLEANING DEVICE AND LAMP

(71) Applicant: Adams Mfg. Corp., Portersville, PA (US)

(72) Inventor: William E. Adams, Portersville, PA (US)

(73) Assignee: Adams Mfg. Corp., Portersville, PA (US)

( * ) Notice: Subject to any disclaimer, the term of this patent is extended or adjusted under 35 U.S.C. 154(b) by 138 days.

(21) Appl. No.: 14/827,604

(22) Filed: Aug. 17, 2015

Related U.S. Application Data

(60) Provisional application No. 62/038,557, filed on Aug. 18, 2014, provisional application No. 62/059,481, filed on Oct. 3, 2014.

(51) Int. Cl.

| | |
|---|---|
| ***A47L 9/30*** | (2006.01) |
| ***A47L 11/40*** | (2006.01) |
| ***F21V 33/00*** | (2006.01) |
| ***F21V 23/06*** | (2006.01) |
| *F21Y 101/02* | (2006.01) |
| *F21W 131/30* | (2006.01) |

(52) U.S. Cl.
CPC ..... *A47L 9/30* (2013.01); *A47L 11/4002* (2013.01); *F21V 23/06* (2013.01); *F21V 33/0044* (2013.01); *F21W 2131/30* (2013.01); *F21Y 2101/02* (2013.01)

(58) Field of Classification Search
CPC ..... A47L 9/30; A47L 11/4002; F21V 23/06; F21V 33/0044; F21W 2131/30; F21Y 2101/02
See application file for complete search history.

(56) References Cited

U.S. PATENT DOCUMENTS

| | | | | |
|---|---|---|---|---|
| 2,017,937 | A * | 10/1935 | Becker | A47L 9/30 15/324 |
| 2,563,717 | A * | 8/1951 | Gerber | A47L 5/362 15/324 |
| D236,648 | S | 9/1975 | Knoepfle | |
| D326,336 | S | 5/1992 | Christ | |
| 5,983,443 | A * | 11/1999 | Redding | A47L 9/30 15/324 |
| 8,696,177 | B1 | 4/2014 | Frost | |
| 2013/0340203 | A1 * | 12/2013 | Cunningham | A47L 9/281 15/324 |

OTHER PUBLICATIONS

Examples of modified vacuum cleaners found at https://www.pinterest.com/gbarrettus/lights-vacuums/ dated Aug. 19, 2015.

* cited by examiner

*Primary Examiner* — Mary Ellen Bowman
(74) *Attorney, Agent, or Firm* — Buchanan Ingersoll & Rooney PC

(57) ABSTRACT

A cleaning device is provided with at least removable lamp console. When the lamp console is attached, the device can be used as a floor or desk lamp to illuminate a room and/or a table-top. The lamp console is removable to enable the device and/or lamp console to be used as a cleaner to clean a floor or other cleaning surface. Each lamp console is provided with a coupling mechanism that enables selective and electro-mechanical communication with a coupling mechanism of a cleaning device. This coupling enables interchangeability of various lamp consoles. Embodiments provide for a lamp console that acts as a handle-extension. Further embodiments provide for a second illumination display disposed on a portion of the cleaning device.

22 Claims, 14 Drawing Sheets

CLEANING DEVICE AND LAMP

CROSS-REFERENCE TO RELATED APPLICATION

The present application claims priority to U.S. Provisional Application Ser. No. 62/038,557 which was filed on Aug. 18, 2014 and U.S. Provisional Application Ser. No. 62/059,481 which was filed on Oct. 3, 2014. The entireties of the Provisional Applications are incorporated by reference herein.

FIELD OF THE INVENTION

The present disclosure describes embodiments of an apparatus directed towards an illuminated cleaning device; and, in particular, an illuminated cleaning device that functions as a floor lamp and/or table lamp.

BACKGROUND OF THE INVENTION

Cleaning devices such as vacuum cleaners and the like are extensively used to clean dust and debris from floors, furniture, and other cleaning surfaces. These devices are typically used only a few hours or less per month, and are typically stored somewhere when not in use. Often these devices are kept in a closet, where they may prevent one from hanging clothes along the full length of the closet bar, may get in the way when trying to remove clothes from the closet, and generally take up much coveted space. Sometimes these devices are stored in a laundry room or utility room where it also can interfere with doing laundry or other tasks.

Homeowners typically do not keep their cleaning devices in a living room, family room or bedroom where the cleaner is in sight. However, many people have one or more floor lamps or table lamps in their living room, family room, or bedroom. The floor lamp may be behind a chair or couch such that the lamp stand is not visible to the casual observed. The table lamp may be placed on a nightstand or desk.

Some cleaners have a light positioned to illuminate the floor in front of the cleaner. These directional lights do not illuminate other portions of the room in which the cleaner is being used.

Artists and some craftsman have modified cleaners to make lamps in which the body of the cleaner is the body of the lamp. In all of these products, the cleaner is modified such that after it has become a lamp, the device can no longer be used as a cleaner.

The art has not created a cleaner that can be used as a floor lamp or table lamp to illuminate a room and still be used as a cleaner to sweep and clean a floor or furniture. Indeed, the art has failed to recognize that such a device would be kept in a living room, bedroom, family room or other room to illuminate that room when not being used as a cleaner, freeing up storage space in a closet.

SUMMARY OF THE INVENTION

I provide a cleaning device configured to serve as a floor lamp and/or desk lamp with the removable attachment of at least one lamp console to a portion of the cleaning device, or with a lamp console being able to be used by folding or otherwise moved out of the way. The cleaning device may be an upright cleaning device, or a compact hand-held cleaning device, or any other mobile cleaning device. An upright cleaning device may be but is not limited to an upright vacuum cleaner, an upright floor scrubber, or an upright power broom. A compact hand-held cleaning device may be but is not limited to a hand-held vacuum such as a Dustbuster® vacuum cleaner. Other mobile cleaning devices may be but are not limited mid-size domestic vacuum cleaners such as a Shop Vac® vacuum cleaner.

A portion of a cleaning device may be provided with a coupler to selectively and removably attach at least one lamp console. Each individual lamp console may be provided with illumination displays having various styles and configurations. When a lamp console is attached, a cleaning device may double as a floor or desk lamp. Some embodiments enable use of a cleaning device while a lamp console is attached and/or detached therefrom. Some embodiments enable manipulation and folding of a lamp console to facilitate use as a cleaner while still attached. Some embodiments enable a lamp console to function as a cleaning device. Other embodiments provide a light inside a portion of a cleaning device. Other embodiments enable an apparatus to further function as a table-top.

While these potential advantages are made possible by the technical solutions offered herein, they are not required to be achieved. The present apparatus can be utilized to achieve technical advantages, whether or not these potential advantages, individually or in combinations, are sought or achieved.

In an exemplary embodiment, a cleaning and illumination apparatus comprises at least one cleaning device, the cleaning device having a cleaning assembly configured to clean a cleaning surface. At least one cleaning assembly coupler is disposed on the at least one cleaning device, the at least one cleaning assembly having electrical contacts. A power cord and electrical wiring are provided and configured to transmit electrical power from an ancillary power supply to the apparatus. At least one lamp console is provide, where each lamp console comprises at least one first illumination display, each configured to emanate light from at least one removably attached first illumination source. Each lamp console further comprises at least one coupler appendage disposed on the at least one first illumination display, each coupler appendage having electrical contacts configured to engage the electrical contacts in the at least one cleaning assembly coupler. The at least one coupler appendage is configured to releasably attach the at least one lamp console to the at least one cleaning assembly coupler such that electricity passing through the power cord travels through the electrical contacts in the at least one lamp console for illuminating the at least one first illumination display. At least one second illumination display is disposed on the cleaning device. The at least one second illumination display is configured to emanate light from at least one removably attached second illumination source. The at least one second illumination display is provided with at least one illumination display shade, each illumination display shade configured to encase the at least one second illumination display and/or at least a portion of the at least one cleaning device. At least one motor is disposed on the cleaning device and/or lamp console and operatively associated with the cleaning assembly. The at least one first and second illumination displays can be illuminated when the at least one coupler appendage is connected to the at least one cleaning assembly coupler, and the at least one motor, the at least one second illumination display, and the at least one cleaning device are operable when the at least one lamp console is connected or removed from the at least one cleaning assembly coupler.

Alternative embodiments provide for at least one handle. The at least one handle is pivotally affixed to the cleaning assembly by a hub assembly having a first electrical contact plate and a second electrical contact plate, each of the first and second electrical contact plate configured to enable the electrical power transfer between each other while facilitating rotational motion of the hub assembly. The hub assembly is provided with a locking mechanism to selectively retain the at least one handle in a desired position. The first electrical contact plate is in electrical communication with the power cord, and the second electrical contact plate is in electrical communication with the at least one cleaning assembly coupler. The at least one cleaning device is provided with a first rechargeable battery configured to selectively receive and store the electrical power from the power cord, and selectively supply the electrical power to the electrical components of the apparatus. The at least one lamp console is provided with a second rechargeable battery configured to selectively receive and store the electrical power from the power cord, and to selectively supply the electrical power to the at least one lamp console even when the at least one lamp console is disconnected from the at least one cleaning assembly coupler. The at least one lamp console is provided with a charging port enabling electrical connection to an ancillary charging station. A coupler mechanism provides the temporary electro-mechanical communication between the at least one coupler appendage and the at least one cleaning assembly coupler. The coupler mechanism of a first lamp console is similar to the coupler mechanism of at least a second lamp console. The at least one lamp console is configured to be a handle-extension to the at least one cleaning device. At least one lamp shade clip is provided and configured to removably attach to the at least one lamp console and support at least one ancillary lamp shade when affixed thereto. At least one cap is provided and configured to removably cover and protect the at least one cleaning assembly coupler when the at least one lamp console is disconnected from the at least one cleaning assembly coupler. The at least one cleaning device comprises an upright cleaning device, the upright cleaning device having a base with a cleaning surface, the upright cleaning device having at least one upright cleaning device handle and an upright body extending between the base and the at least one upright cleaning device handle. The upright cleaning device is provided with an upright cleaning device motor. The lamp console is provided with the cleaning assembly.

BRIEF DESCRIPTION OF THE DRAWINGS

The above and other objects, aspects, features, advantages and possible applications of the present invention will be more apparent from the following more particular description thereof, presented in conjunction with the following drawings, in which.

DETAILED DESCRIPTION OF THE INVENTION

The following description provides embodiments contemplated for carrying out the present invention. This description is not to be taken in a limiting sense, but is made merely for the purpose of describing the general principles and features of the present invention. The scope of the present invention should be determined with reference to the claims.

Figure 1:
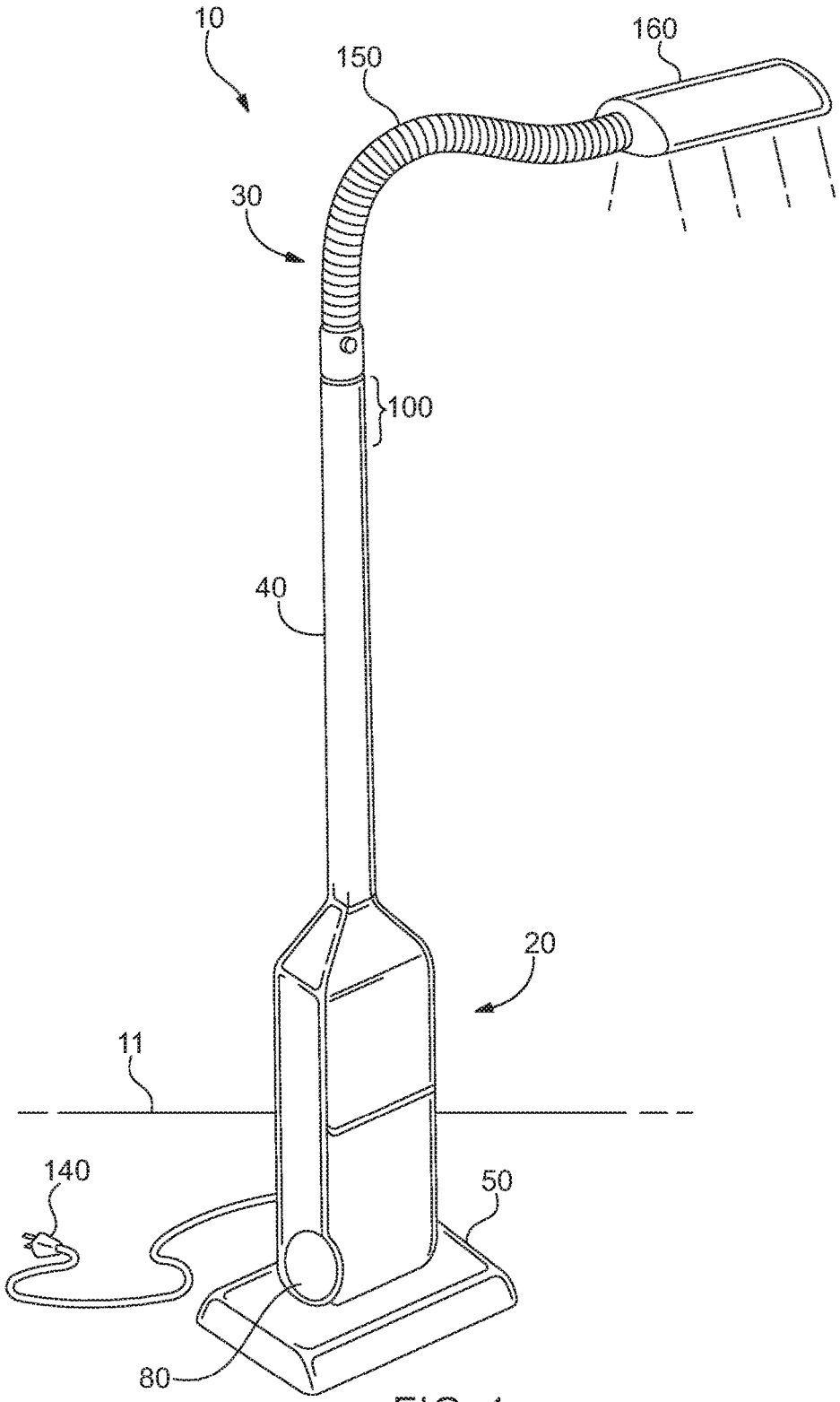
FIG. 1 is an exemplary embodiment of an apparatus with a lamp console attached to a cleaning device.
Figure 6:
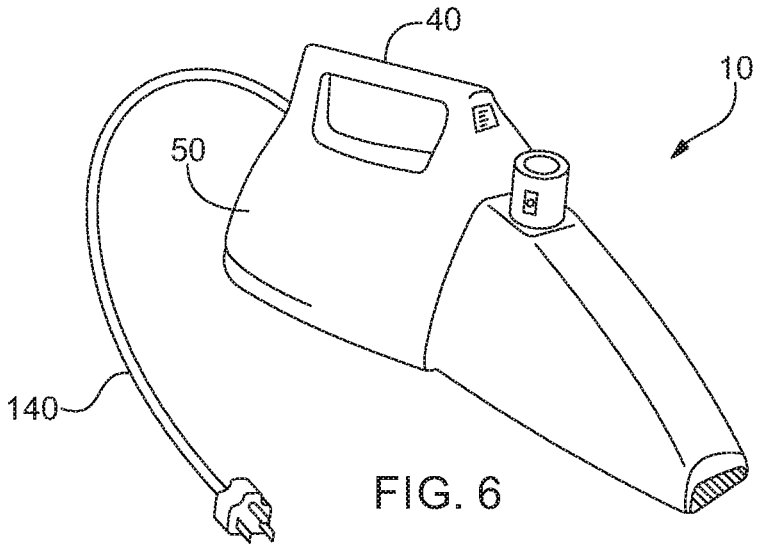
FIG. 6 is an exemplary embodiment of an apparatus without a lamp console attached thereto.
Figure 7:
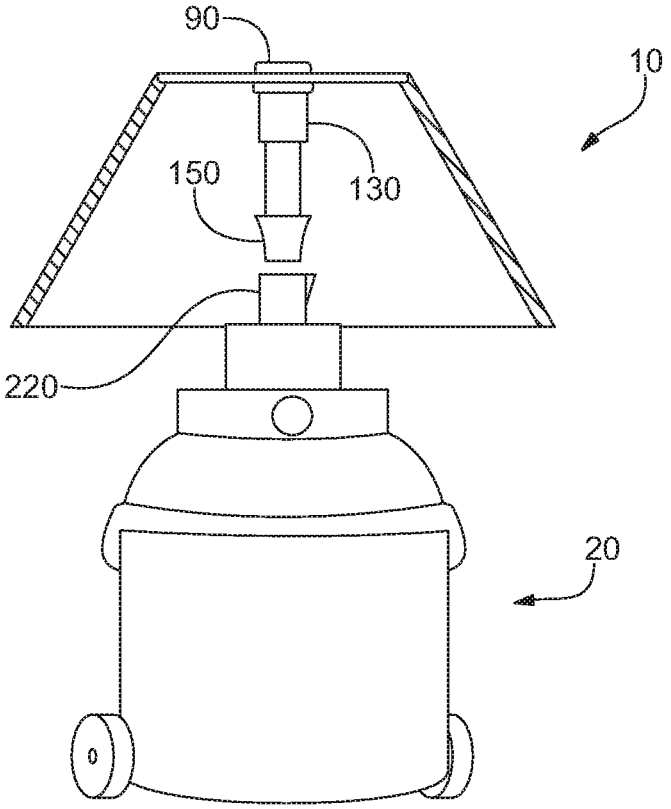
FIG. 7 is an exemplary embodiment of an apparatus with a lamp console attached to a cleaning device.

As can be seen in a present preferred embodiment shown in FIG. 1 my cleaning device and lamp device 10 (herein referred to as an "apparatus") has a cleaning device 20 and at least one lamp console 30. The cleaning device may be an upright cleaning device, or a compact hand-held cleaning device, or any other mobile cleaning device. An upright cleaning device may be but is not limited to an upright vacuum cleaner, an upright floor scrubber, or an upright power broom, as shown in FIG. 1. A compact hand-held cleaning device may be but is not limited to a hand-held vacuum such as a Dustbuster® vacuum cleaner, as shown in FIG. 6. Other mobile cleaning devices may be but are not limited to mid-size domestic vacuum cleaners such as a Shop Vac® vacuum cleaner, as shown in FIG. 7.

Each cleaning device 20 comprises a cleaning assembly 50, which may have a housing configured to cover and protect any operative components of the cleaning assembly 50. Cleaning assemblies 50 for any of the referenced cleaning devices 20 are common in the art, and a description of the construction of any one of them within the present disclosure is meant to be exemplary.

Cleaning devices 20 that are configured as vacuum cleaners may comprise operative components (not shown) such as a vacuum motor, which may be an electrically operated vacuum fan or vacuum pump, in fluid communication with a manifold or conduit system that fluidly connects an inlet port and an outlet port of a cleaning device 20. A vacuum motor, when activated, is configured to generate a partial vacuum within a manifold or conduit system such that a pressure differential is created between an outlet port and an inlet port. In an attempt to reach equilibrium, fluid, including dust and debris, at an inlet port fluxes toward an outlet port. An outlet port may be in fluid communication with a container, which may have at least one filter assembly. A filter assembly separates particulates from the fluid, which are contained within a container, before the fluid is expelled through an exhaust port of a container. A vacuum motor may be located within, onto, or near a cleaning assembly 50. However, a vacuum motor may also be located anywhere on an apparatus 10. For example, a motor may be disposed on a handle 40 portion of an apparatus 10. As another example, a motor may be disposed on a lamp console 30 of an apparatus 10.

Cleaning devices 20 that are configured as floor scrubbers may comprise operative components (not shown) such as a dispensing and scrubbing mechanism. A dispensing and scrubbing mechanism may comprise a reservoir in fluid communication with at least one electrically operated motor, such as a dispensing pump, that directs cleansing fluid from a reservoir to at least one nozzle. Upon activation of a dispensing pump of a dispensing and scrubbing mechanism, cleansing fluid may be drawn from the reservoir and dispensed through a nozzle and onto a cleaning surface 11. A reservoir may be provided with a fill cap enabling replenishment of cleansing fluids, such as water or cleaning solution, as a dispensing and scrubbing unit is employed. A floor scrubber may include a heating element disposed between a reservoir and a nozzle to transfer heat into the cleansing fluid before it is dispensed through a nozzle. Heat transfer may be performed by a heat exchanger, a thermostat sensor, and a time sensor that may be provided with a heating element. An electrically operated motor may be located within, onto, or near a cleaning assembly 50. However, an electrically operated motor may also be located anywhere on an apparatus 10. For example, an electrically operated motor may be disposed on a handle 40 portion of an apparatus 10. As another example, an electrically operated motor may be disposed on a lamp console 30 of an apparatus 10.

Cleaning devices 20 that are configured as power brooms may comprise operative components (not shown) such as a bristled roll bar mechanism. A bristled roll bar mechanism may be operated by an electric motor. An electric motor rotates when such a leaning device 20 is activated to make abrasive contact with a cleaning surface 11 and loosen and entrain debris into a cleaning assembly 50. An electric motor may be located within, onto, or near a cleaning assembly 50. However, an electrical operated motor may also be located anywhere on an apparatus 10. For example, an electric motor may be disposed on a handle 40 portion of an apparatus 10. As another example, an electric motor may be disposed on a lamp console 30 of an apparatus 10.

Other cleaning devices 20 may have cleaning assemblies 50 that employ other mechanical, chemical, or other phenomenon to clean dirt and debris from cleaning surfaces 11, and one skilled in the art, with the benefit of the present disclosure, will understand that the teachings of the present apparatus 10 encompass all such cleansing devices 20. Still other cleaning devices 20 may have cleaning assemblies 50 that employ any combination of the various mechanisms described above for which the teachings of the present apparatus 10, with the benefit of the present disclosure, are applicable thereto.

As by way of example, a floor scrubber may also have a bristled roll bar mechanism within a cleaning assembly 50. When cleansing fluid is dispensed on a cleaning surface 11, a bristled roll bar not only makes abrasive contact with a cleaning surface 11 but may also agitate the cleansing fluid to catalyze any reactions necessary to loosen dirt and debris from a cleaning surface 11.

As another example, a vacuum cleaner may be configured to be a wet/dry vacuum cleaner with the use of a hydrophobic and air permeable filter. Such a filter may comprise expanded polytetrafluoroethylene. A vacuum cleaner may then include a dispensing and scrubbing mechanism housed within its cleaning assembly 50. Additionally, a vacuum cleaner may be provided with a bristled roll bar mechanism described above that rotates when a vacuum motor is activated to make abrasive contact with a cleaning surface 11 and loosen and entrain debris into the fluid flow of a vacuum cleaner.

As another example, other embodiments of may include a removably attached container to contain dirt and debris that is collected by a cleaning device 20 and/or a lid/door on a container for cleaning and maintenance purposes. Other embodiments may include at least one wheel rotatingly affixed to a cleaning surface of a cleaning assembly 50 to provide smooth and easy manipulation of an apparatus 10 by allowing a wheel to roll an apparatus 10 on a cleaning surface 11.

As another example, embodiments may have additional hoses that removably extend from a manifold or conduit system of a vacuum motor to enable more directed and accommodating cleaning, such as in areas exhibiting compromised spaces. For instance, a user may want to vacuum debris from within a couch structure, or vacuum debris from underneath a heavy appliance, etc. These hoses may be configured to facilitate the removable connection, via interference fit for example, with at least one wand adapter. Each wand adapter may be configured to exploit some aspect of fluid dynamics to better provide a level of pressure difference and volumetric displacement that may be desired.

In an exemplary embodiment, a cleaning assembly 50 may be provided with electrical circuitry, including a power cord 140, to place electrical components of an apparatus 10 into electrical communication with an ancillary electrical power supply (not shown). An apparatus 10 may be provided with a first rechargeable battery (not shown) to selectively receive and store electrical power from an ancillary electrical power supply. A first rechargeable battery may also be configured to selectively supply electrical power to electrical components of an apparatus 10. An ancillary electrical power supply is envisioned to provide electrical power in a form of alternating current, such as 120 VAC for example, so electrical circuitry of an apparatus 10 may comprise necessary inverters and transformers to facilitate proper electrical power transfer between an ancillary electrical power supply, a first rechargeable battery, and other electrical components of an apparatus 10. A first rechargeable battery and associated electrical wiring, inverters, transformers, and a power cord 140 connection may be contained within a housing of a cleaning assembly 50. However, these components may be disposed anywhere on an apparatus 10. Placing these components on an apparatus 10 at a location other than within a housing of a cleaning assembly 50 may be beneficial where a motor of a cleaning device 20 is disposed in a location other than within, on, or near a cleaning assembly 50. For example, a motor may be disposed on a handle 40 or disposed on a lamp console 30. Some embodiments may provide for at least one light 250 disposed within or on a cleaning assembly 50. A light may be placed into electrical communication with electrical circuitry and/or a first rechargeable battery of an apparatus 10.

A lamp console 30 may be provided with a coupling appendage 150. Some configurations of a coupler appendage 150 and first illumination display 160, such as an elongated flexible corrugated tube and an actuating arm with lamp shade enable stowage of a lamp console 30 by folding it into a compact configuration against a portion of an apparatus 10, such as a handle 40 or cleaning assembly 50 for example.

Figure 2:
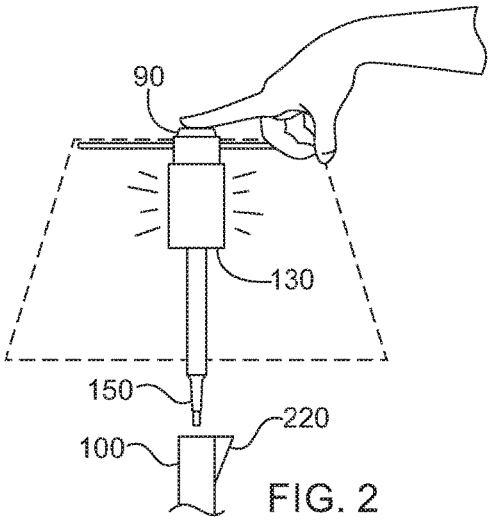
FIG. 2 is a side view partially in section of an exemplary embodiment having a push button release of the lamp console from the cleaning device.

As shown in FIG. 2, a lamp console 30 may comprise an illumination source 130 and may be provided with a coupling appendage 150, which may be provided with an electrical contact plate. A coupling appendage 150 may comprise a coupling mechanism enabling removable attachment to a cleaning assembly coupler 220. A coupling mechanism may comprise any one of commonly known coupler-fasteners that may facilitate removable fastening between a cleaning assembly coupler 220 and a coupling appendage 150. These may include, but are not limited to: 1) threading engagement; 2) a quick connect-disconnect coupling; 3) a quick connect bayonet style fastener; 4) quick-connect magnetic couplings; 5) detent and spring-loaded pin tumbler assembly; 6) deflection clips; 7) tension knob/screw assembly; and, 8) an interference fit. In the embodiment of FIG. 2 a push button is provided to release the lamp assembly. Electrical wiring may be routed from an electrical contact plate to enable electrical communication between each socket associated with each illumination source 130 and a control module 90. Depending on a type of coupling mechanism utilized, each lamp console 30 may be selectively removed, replaced, or interchanged. Various styles and configurations of a body of a coupler appendage 150 may be utilized. This may include but is not limited to an elongated flexible corrugated tube that resiliently retains a shape when manipulated, an elongated rigid shaft, a "T"-shaped handle, etc. Various styles and configurations of a lamp console 30 may be utilized.

A coupling appendage 150 may be provided with an electrical contact plate. Electrical wiring may further extend from a control module 90 to a contact plate disposed on, within, or near, a cleaning assembly coupler 220. An electrical contact plate may be configured to facilitate electrical power transfer to each illumination source 130 via another electrical contact plate of a lamp console 30.

A cleaning assembly coupler 220 may facilitate selective electro-mechanical communication between a cleaning device 20 and a lamp console 30 via engagement between a cleaning assembly coupler 220 and a coupling appendage 150. A cleaning assembly coupler 220 may be disposed on a cleaning device 20, which may be on a cleaning assembly 50, a handle 40, an upright body portion 230 of an upright cleaning device, a base 240 of an upright cleaning device, and/or any other location on an apparatus 10. A lamp console 30 may be configured to removably attach to a cleaning device 20 via a cleaning assembly coupler 220. When a lamp console 30 is coupled to a cleaning assembly coupler 220, electrical contact plates may engage to facilitate electrical communication between a control module 90 and an illumination source 130 of a lamp console 30.

A lamp console 30 may comprise a first illumination display 160. A first illumination display 160 may contain at least one socket (not shown) by which at least one illumination source 130 may be removably secured and placed into electrical communication with a control module 90. Each illumination source 130 may include but is not limited to an LED, an incandescent bulb, a tungsten bulbs, a halogen bulb, a fluorescent bulb, etc. Each socket may be configured to removably secure each type of illumination source 130 within a first illumination display 160.

Various styles and configurations of a lamp console may be utilized. This may include, but is not limited to a removable lamp shade assembly, an actuating arm with lamp shade, a lamp shade bar pivotally attached to a coupling appendage 150, a "T"-shaped lamp shade, a saucer shaped lamp shade, a hour shaped lamp shade, a conical shaped lamp shade, etc. Other examples may include a halo shaped light bar, a rotating light ball, etc.

Figure 3:
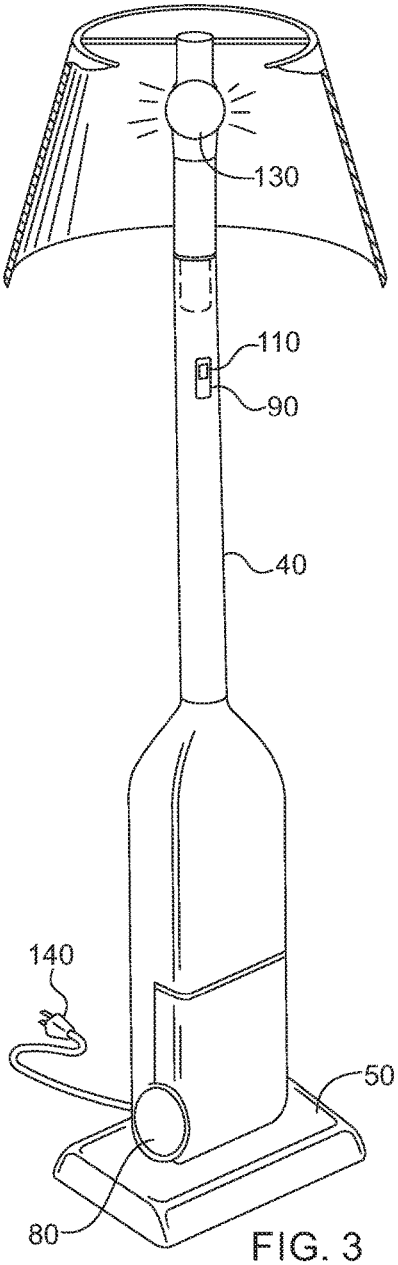
FIG. 3 an FIG. 3*a* are perspective views of another an exemplary embodiment of my apparatus.
Figure 3A:
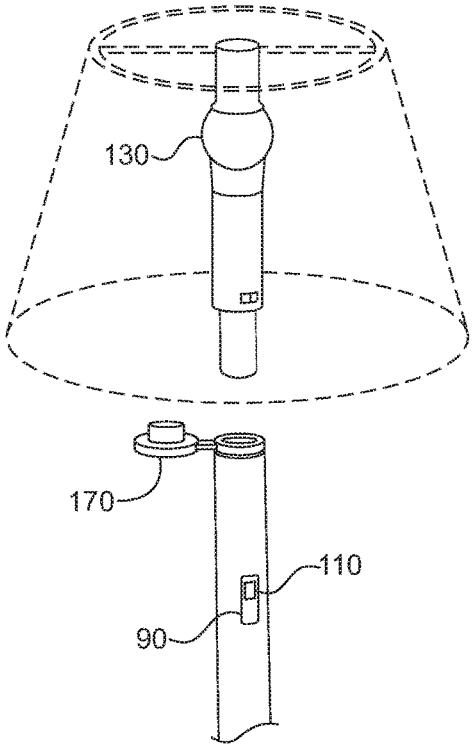

As shown in FIG. 3 and FIG. 3*a*, a portion of a cleaning device 20 may be provided with a cap 170 that is configured to cover and protect a cleaning assembly coupler 220 when a lamp console 30 is disconnected from an apparatus 10. Some lamp console 30 designs may preclude, or at least impede, a use of an apparatus 10 as a cleaning device 20 when connected to a cleaning assembly coupler 220, not because of rendering a cleaning device 20 inoperable but because of a hindrance it provides in manipulation of an apparatus 10. Therefore, with such embodiments, it is envisioned that a lamp console 30 would be removed before engaging in cleaning activities with an apparatus 10. Thus, a use of a cap 170 may provide protection with these embodiments. A cap 170 may be configured to be removable with a cleaning assembly coupler 220. This may be achieved via an interference fit, for example. A cap 170 may be permanently affixed to a portion of an apparatus 10 and configured to provide selective coverage and protection of a cleaning assembly coupler 220. This may be achieved via a hinged connection. A cap 170 may also be threaded to enable threading engagement with a complementary thread of a cleaning assembly coupler 220.

Electrical wiring may be routed from an ancillary electrical power supply and/or a first rechargeable battery to a control module 90. A control module 90 may comprise a switching assembly in electro-mechanical communication with control buttons 110. A control module 90 may be configured to selectively and independently provide electrical power from an ancillary electrical power supply to a first rechargeable battery 70, a cleaning assembly 50, each illumination source 130 of a lamp console 30, a motor, and other electrical components of an apparatus 10. A control module 90 may be configured to selectively and independently provide electrical power to each electrical component from a first rechargeable battery 70 for the same.

Control buttons 110 may be disposed on an outer surface of an apparatus 10. Control buttons 110 may comprise a plurality of buttons, where any one button may be located at a disparate location from the other buttons. For example, a control button 110 for a vacuum motor may be located on a first portion of an apparatus 10, whereas a control buttons 110 for a lamp console 30 and bristled roll bar mechanism may be located on a second portion of an apparatus 10. Control buttons 110 may also comprise other actuation mechanisms. For example, control buttons 110 may be but are not limited to a pull-chain, a rocker switch, a touchpad, a dial-knob, and the like.

Figure 4:
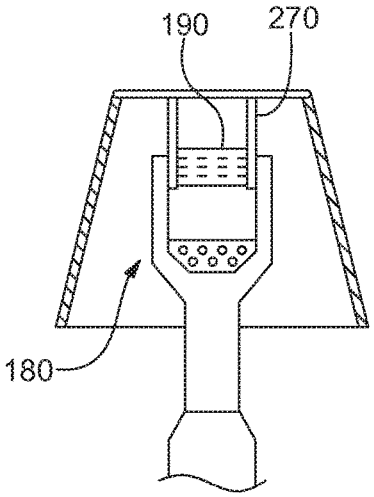
FIG. 4 and FIG. 4*a* are a front views of other preferred embodiments in which the lamp console is configured as a handle.
Figure 4A:
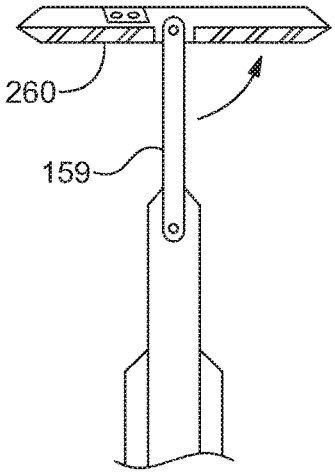
Figure 9:
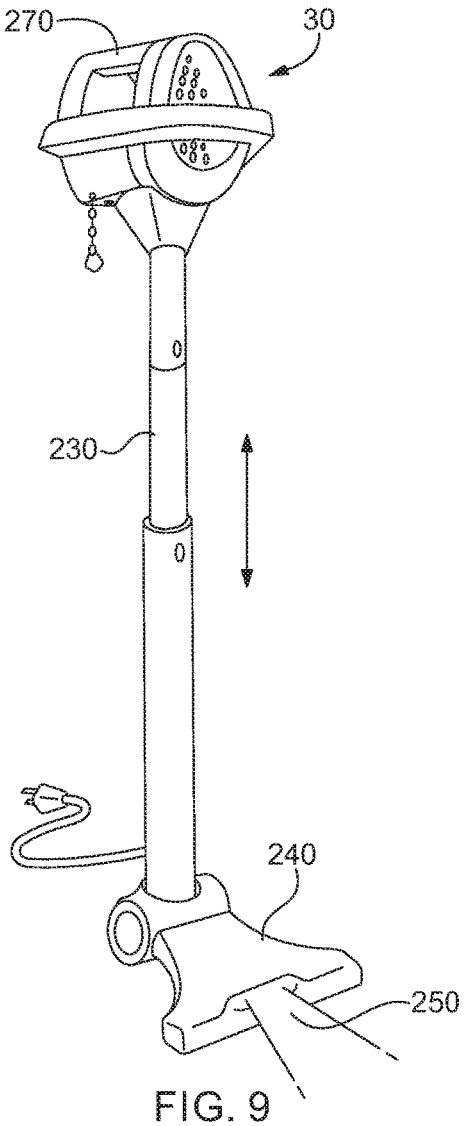
FIG. 9 is an exemplary embodiment having a light bar or light ring.

As shown in FIGS. 4 and 9, a lamp console 30 may be configured to be employed as a handle-extension to a cleaning device 20 by being provided with a lamp console handle 280. A lamp console 30 configured as a handle-extension may be a handle-extension applied to a cleaning assembly 50 portion, a handle 40 portion, and/or any other portion of an apparatus 10. A lamp console 30 may alternatively be shaped as a handgrip 180 with illumination sources 130 disposed throughout a handgrip 180. A handgrip 180 may be grasped about a handlebar portion 190 with a user's hand to manipulate an apparatus 10 for used as a cleaning device 20 without having to remove a lamp console 30.

A handlebar portion 190 may be configured to rotate by rotatingly affixing a handlebar portion 190 to a handgrip 180 with a plurality of hub assemblies 80 and electrical contact plates. A hub assembly 80 may comprise a rotating shaft, at least one bearing mechanism, and at least one retaining plate; however, other rotating attachments/engagements may be utilized. A handlebar portion 190 may be affixed to a rotating shaft, and distal ends of a rotating shaft may be rotatingly engaged with a handgrip 180 via each bearing mechanism and retaining plate. At least one retaining plate may comprise an electrical contact plate, where each electrical contact plate may be configured to enable electrical power transfer between each other while facilitating rotational motion of a hub assembly 80. Therefore, the electronics of a handgrip 180 and the electronics of a handlebar portion 190 may be in continuous electrical communication as a handlebar portion 190 is rotated. It will be appreciated by one skilled in the art, with the benefit of the present disclosure, that other methods and configurations of enabling electrical power transfer while facilitating rotational motion may be utilized.

A handgrip 180 may be further configured to support a lamp shade via at least one lamp shade clip 270, as shown in FIG. 4. A lamp shade clip 270 may comprise a bracket having at least one arm with a collar and a saddle. Each collar may be configured to engage a handlebar portion 190, via an interference fit for example, such that an arm and saddle are supported in an upright and erect position. A lamp shade may then rest upon or otherwise be removably affixed to a saddle. While a lamp shade clip 270 is shown in FIG. 4 as being utilized with a handgrip 180 embodiment of a lamp console 30, a lamp shade clip 270 may be utilized with any embodiment of a lamp console 30.

Figure 5:
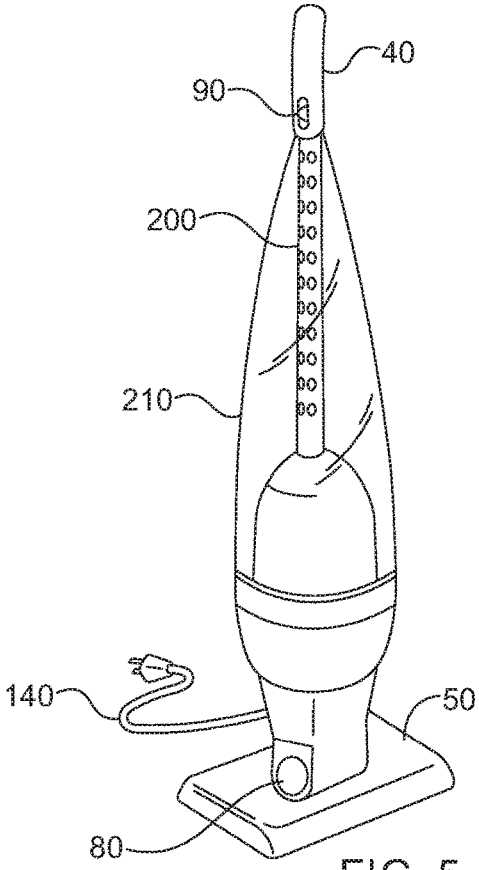
FIG. 5 is an exemplary embodiment having a vertical illumination display and illumination display shade.

In an exemplary embodiment, an apparatus 10 may be provided with a second illumination display 200 that may be disposed on a portion of an apparatus 10, as shown in FIG. 5. A second illumination display 200 may be disposed on a cleaning assembly 50 portion, a handle 40 portion, an upright body portion 230, a lamp console 30, and/or any portion of an apparatus 10. A second illumination display shade 210 may be provided. A second illumination display shade 210 may be configured to encase a second illumination display 200. A second illumination display shade 210 may be configured to also cover a portion of a cleaning device 20 and/or other portion of an apparatus 10. A second illumination display shade 210 may be opaque, translucent, transparent, and/or any combination/permutation thereof. A second illumination display shade 210 may comprise a bifurcated dome or conical structure that may be configured to removably secure to itself and/or an apparatus 10. The removable attachment thereof may be achieved by screw or bolt fasteners, or may be achieved by deflection clips, etc. In this embodiment, a control module 90 may be configured to enable at least "vacuum on/off" states, "upper illumination display on/off" states, and "lower illumination display on/off" states.

In an exemplary embodiment, a second rechargeable battery (not shown) may be disposed within a lamp console 30 to selectively receive and store electrical power from an ancillary electrical power supply via a control module 90. A second rechargeable battery may be configured to selectively supply electrical power to electrical components of a lamp console 30 via a light control switch 260 even when a lamp console 30 may be disconnected from a cleaning assembly coupler 220. In this embodiment, a lamp console 30 may be used as a stand-alone lamp or a flashlight. A light control switch 260 may be disposed on a lamp console 30 to enable selective electrical power transfer from a second rechargeable battery to a first illumination display 160, thus enabling at least "upper illumination display on/off" states. A light control switch 260 may comprise but it not limited to a button assembly, a pull-chain, a rocker switch, a touchpad, a dial-knob, and the like.

A second rechargeable battery may be recharged by connecting a lamp console 30 to a cleaning device 20 having a cleaning assembly coupler 220 as described above. However, these embodiments to may also include a separate charging port (not shown) enabling electrical connection to a charging station having the necessary inverters, transformers, and power cord to independently recharge a second rechargeable battery. Therefore, a lamp console 30 in this embodiment may be used with virtually any existing cleaning device having a means to couple a lamp console 30 thereto, such as an elongated handle for example, even if that existing cleaning device is not enabled to transfer electrical power to a lamp console 30. Some coupler mechanisms, such as a tension knob/screw assembly or an interference fit for example, may be used to couple a lamp console 30 to an existing cleaning device having an elongated handle or similar structure so that a lamp console 30 may be used on an existing cleaning device even if that device has no cleaning assembly coupler 220.

Some embodiments may provide for an upright cleaning device 20, as shown in FIGS. 1, 2, 3, and 5. An upright cleaning device 20 may comprise an upright body having a handle 40 and a cleaning assembly 50. A handle 40 may be pivotally attached to a cleaning assembly 50. A handle 40 that is pivotally attached may be selectively secured in a desired position as it is pivoted. A desired position may be one that is substantially perpendicular to a cleaning surface 11. This may be a stowed position for a device 20. In this regard, an upright cleaning device 20 may be deemed to stand "upright" when a handle 40 is placed in a stowed position.

In an exemplary embodiment, a handle 40 may comprise an elongated shaft, which may have a curvilinear shape to provide ornamental aesthetics and utilitarian ergonomic aspects to an apparatus 10. A handle 40 may comprise at least two shaft portions telescopingly engaged to each other to enable length adjustment of a handle 40. Length adjustment of a handle 40 may provide added dexterity when using an apparatus 10 as a cleaning device 20. Length adjustment of a handle 20 may enable height and/or length adjustment when using an apparatus 10 as a lamp. A telescoping engagement may be achieved by, but is not limited to: 1) complementary threading engagements of each shaft; 2) a spring-loaded pin and detent configuration; and, 3) a tension knob/screw assembly.

While a handle 40 is shown being employed with an upright version of a cleaning device 20, a cleaning device 20 need not be an upright version to utilize a disclosed handle 40. Any disclosed handle 40 may be utilized with any cleaning device 20 disclosed herein.

If a first rechargeable battery, associated electrical wiring and electronics, and/or any motor referenced above are disposed at disparate locations on a cleaning device 50 having a handle 40, then further electrical wiring or electrical connections may be provided to enable electrical power transfer to a handle 40. Because a handle 40 may be pivotally attached to a cleaning assembly 50, electrical contact plates may be employed to facilitate electrical power transfer from electrical wiring and electronics of a cleaning assembly 50 to electrical wiring and electronics of a handle 40. A handle 40 may be pivotally attached to a cleaning assembly 50 via a hub assembly 80 in a manner described above with a plurality of hub assemblies and electrical contact plates. It will be appreciated by one skilled in the art, with the benefit of the present disclosure, that other methods and configurations of enabling electrical power transfer from a cleaning assembly 50 to a handle 40 may be utilized.

A hub assembly 80 may be provided with a locking mechanism to selectively retain a handle 40 in a desired position. This may include an upright position. An upright position may be defined by a handle 40 being substantially normal to a cleaning surface 11 when a bottom surface of a cleaning assembly 50 abuts a cleaning surface 11. When locked in an upright position, a handle 40 may be in its stowed position; however, it will be understood, with the benefit of the present disclosure, that any position may be defined as a stowed position. A locking mechanism may comprise at least one detent disposed on a housing, where each detent may be configured to mechanically engage a spring-loaded pin disposed on a handle 40 when a handle 40 is rotated to an upright position. When engaged, a hub assembly's 80 rotation may be arrested. Disengagement may be effectuated by a finger/hand/foot lever disposed on an apparatus 10 that may be configured to retract a spring-loaded pin from a detent with which it may be engaged. When disengaged, a handle 40 may be rotated to an operating position, which may be defined by any angle from a substantially normal angle of an upright position. One skilled in the art, with the benefit of this present disclosure, will understand that other locking mechanisms may be utilized without deviating from the teachings of an apparatus 10.

Figure 8:
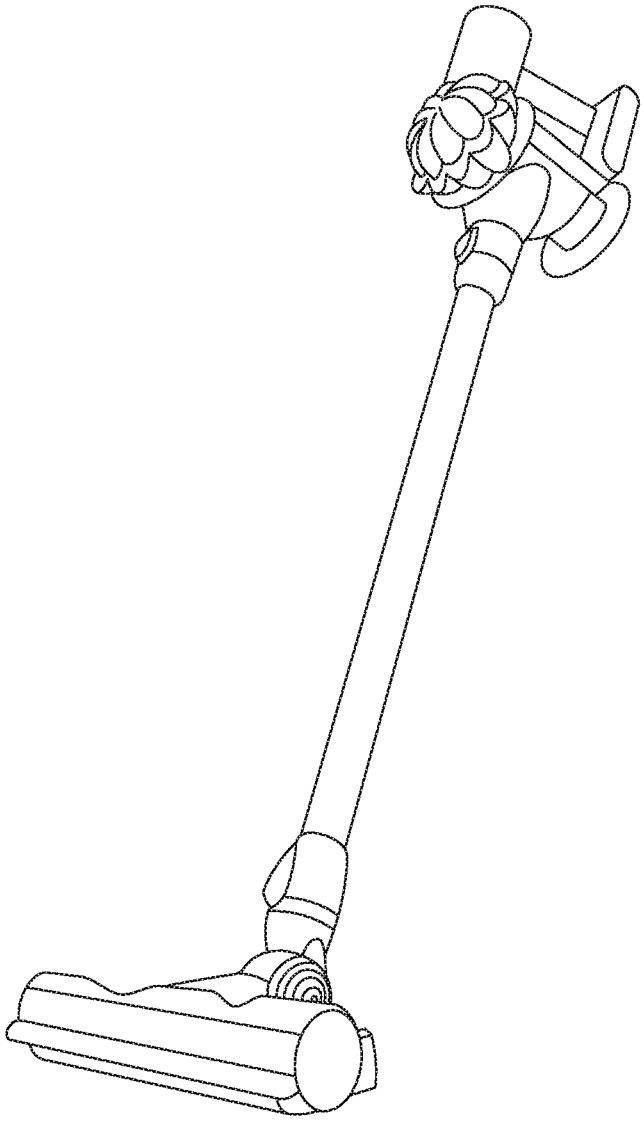
FIG. 8 is an exemplary embodiment of a cleaning device with a motor disposed on a handle thereof.

As described earlier, a motor for a cleaning assembly 50 may be disposed on, within, or near a cleaning assembly 50 and/or elsewhere in an apparatus 10. For example, a motor may be disposed on a handle 40 portion of an apparatus 10, as shown in FIG. 8. As another example, a motor may be disposed on a lamp console 30 of an apparatus 10. To accommodate various placements of motors and other operative components of an apparatus 10, a cleaning assembly coupler 50 may be disposed anywhere on an apparatus 10. This may be, for example, on a portion of a cleaning assembly 50, a top 100 portion of a handle 40, an intermediate location of a handle 40, and/or any combination thereof. In addition, where a cleaning device 20 is provided with a handle 40, and a motor of a cleaning device 20 is disposed on a handle 40, a cleaning assembly coupler 220 may be disposed on that motor or a housing covering that motor.

A cleaning assembly 50 may have dimensions suitable to provide a supportive base 240 to hold an apparatus 10 erect while a handle 40, along with any motor that may be disposed on a handle 40 and/or any lamp console 30 that may be secured to a handle 40, is locked in a stowed position. The components within the cleaning assembly 50 should provide adequate weight for such purposes, but it is envisioned that additional counterweights (not shown) may be employed by disposing them on a cleaning assembly 50 and/or elsewhere on an apparatus 10.

Figure 10:
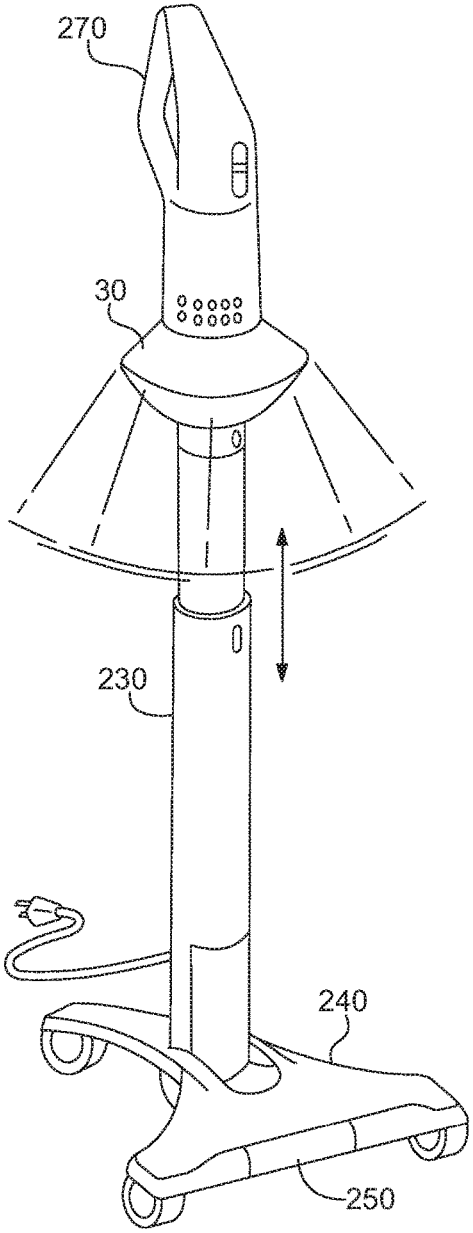
FIG. 10 is an exemplary embodiment of an apparatus with a base having a tri-pod configuration.
Figure 11:
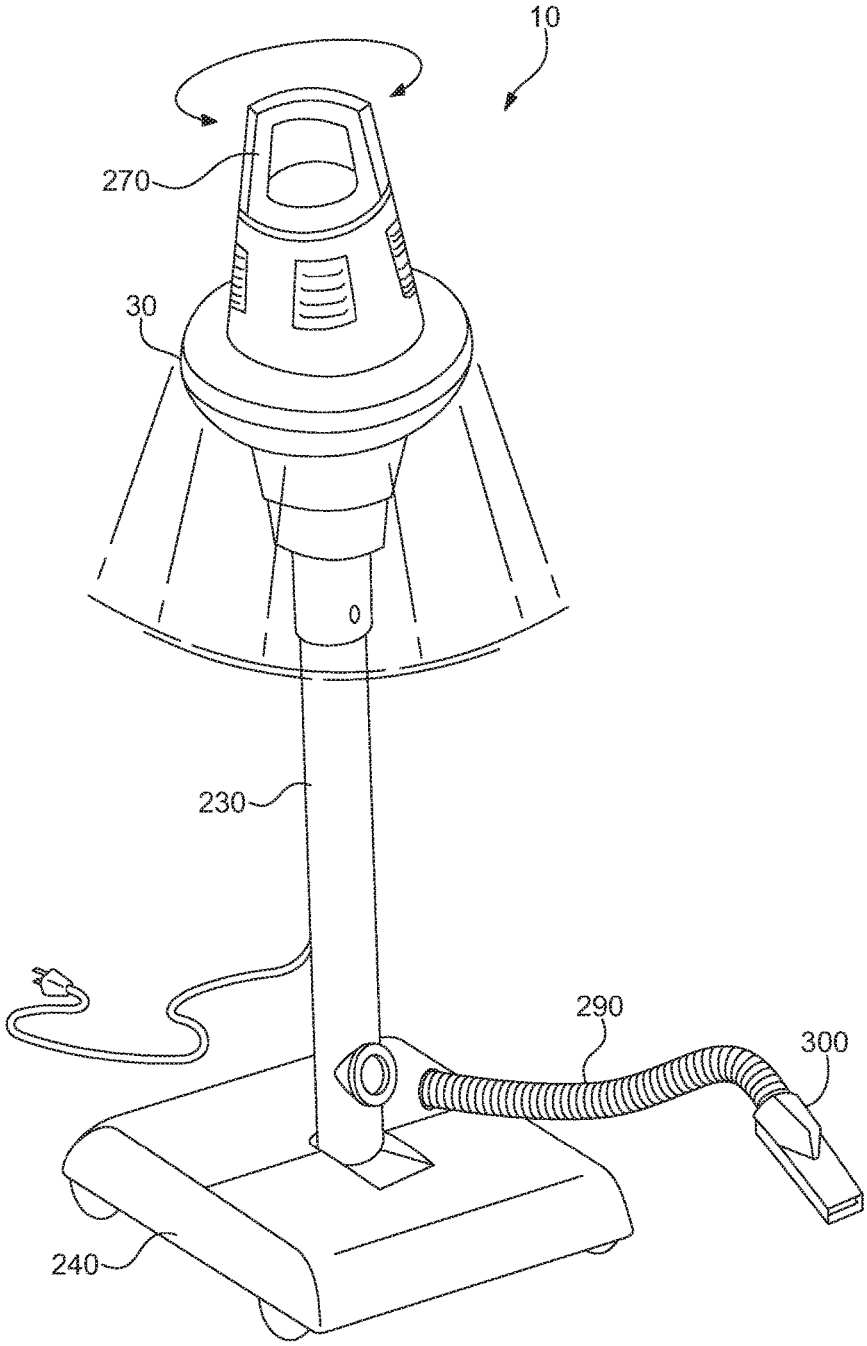
FIG. 11 is an exemplary embodiment of an apparatus with a swivel handle portion of a lamp console.

As another example, a lamp console 30 may be configured as a cleaning device 20, wherein a motor is disposed thereon. In this embodiment, a cleaning device 20 may be a hand-held cleaning device that may be employed as a hand-held cleaning device when de-coupled from an upright body portion 230 of an apparatus 10, as shown in FIGS. 9 and 10. When coupled to an upright body portion 230, an operable upright cleaning device may be created. Additional hoses 290 and wand adapters 300 may be employed with such a lamp console 30 when it is de-coupled. Additional hoses 290 and wand adapters 300 may also be employed while such a lamp console 30 is coupled to an upright body portion 230 of an apparatus 10. An upright body portion 230 in this embodiment may be provided with a base 240 with a cleaning surface. A base 240 may include any combination of the various mechanisms described above to complement and/or supplement cleaning functions of an apparatus 10. A base 240 may comprise of various shapes and configurations. For example, a base 240 may have a tri-pod configuration. An upright body portion 230 may extend from a central portion of a base or an off-set portion of a base 240 to accommodate stylistic configurations and provide adequate balancing of an apparatus 10. An upright body portion 230 may be statically affixed to a base 230 or pivotally affixed. At least one light 250 may be disposed within or on a base 240 and/or upright body portion 230. A light 250 may be placed into electrical communication with electrical circuitry and/or a first rechargeable battery of an apparatus 10. Exemplary embodiments thereof are illustrated in FIGS. 9 and 10.

In an exemplary embodiment, a first illumination display 160 may be configured to emit light in any single or in multiple directions. A lamp console 30 may be configured to swivel, pivot, or rotate so as to enable directional control of light emission therefrom. A first illumination display 160 may also be configured to swivel, pivot, or rotate for the same. Exemplary embodiments thereof are shown in FIGS. 11, and 14-17.

Figure 12:
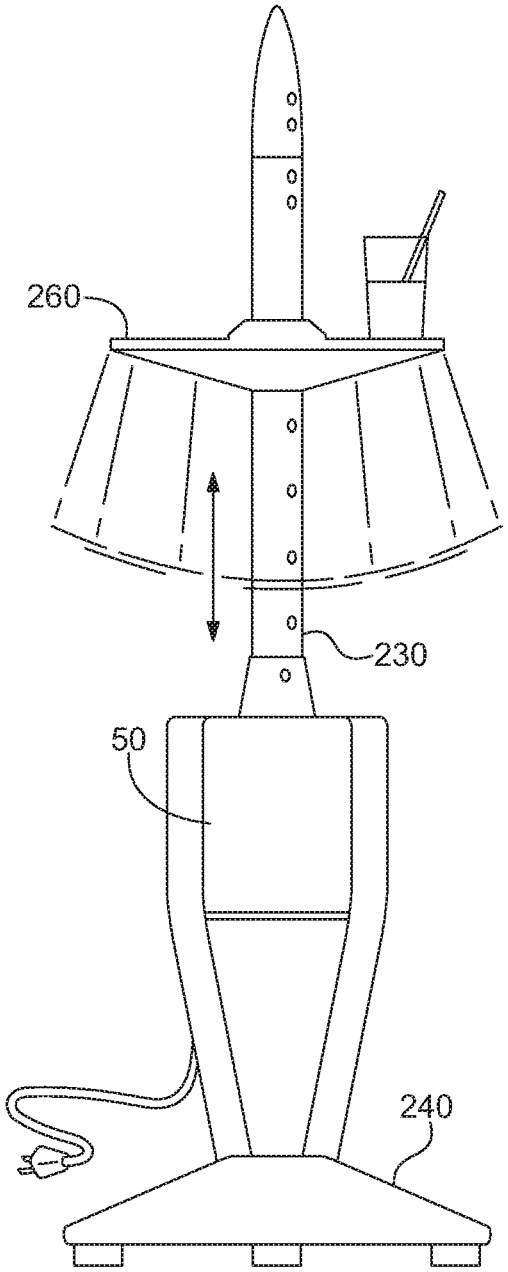
FIG. 12 is an exemplary embodiment of an apparatus configured to function as a shelf or table-top.
Figure 13:
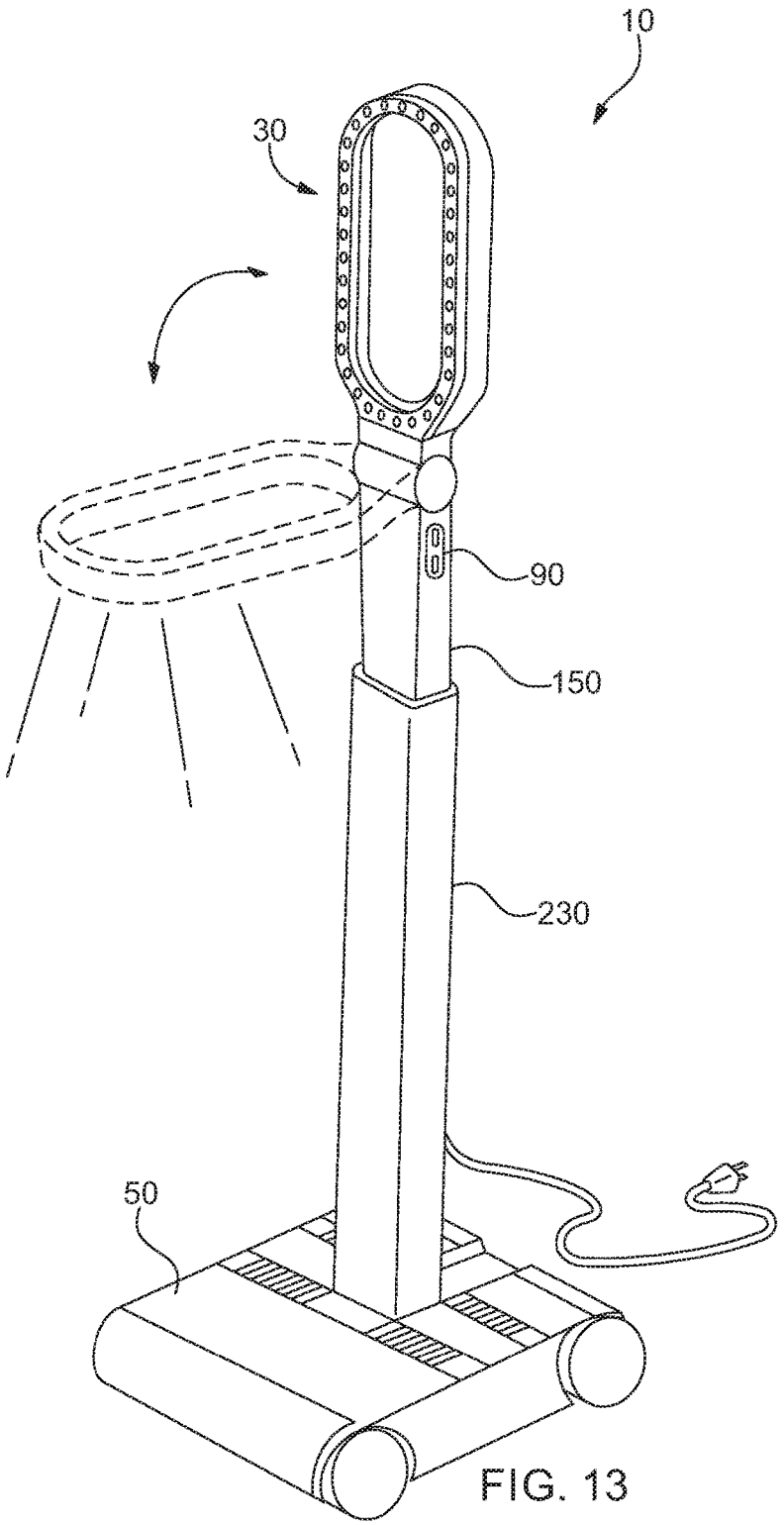
FIG. 13 is an exemplary embodiment of an apparatus with a pivoting handle portion of a lamp console.
Figure 14:
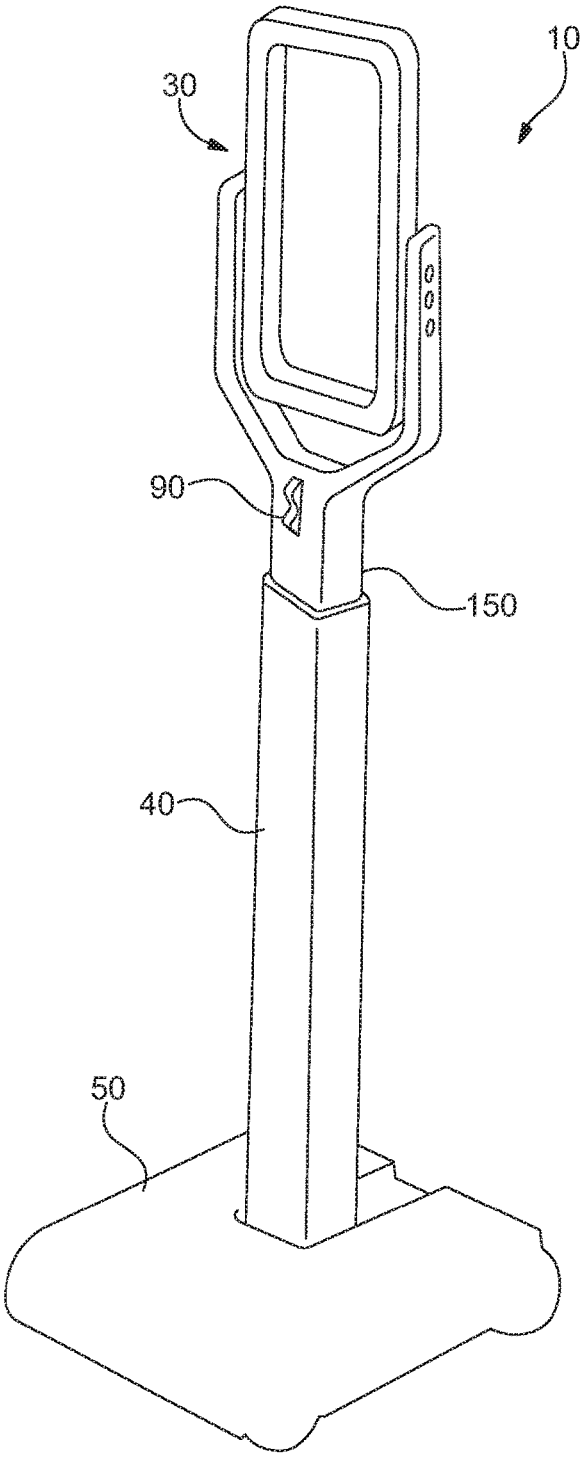
FIG. 14 is another exemplary embodiment of an apparatus with a pivoting handle portion of a lamp console.
Figure 15:
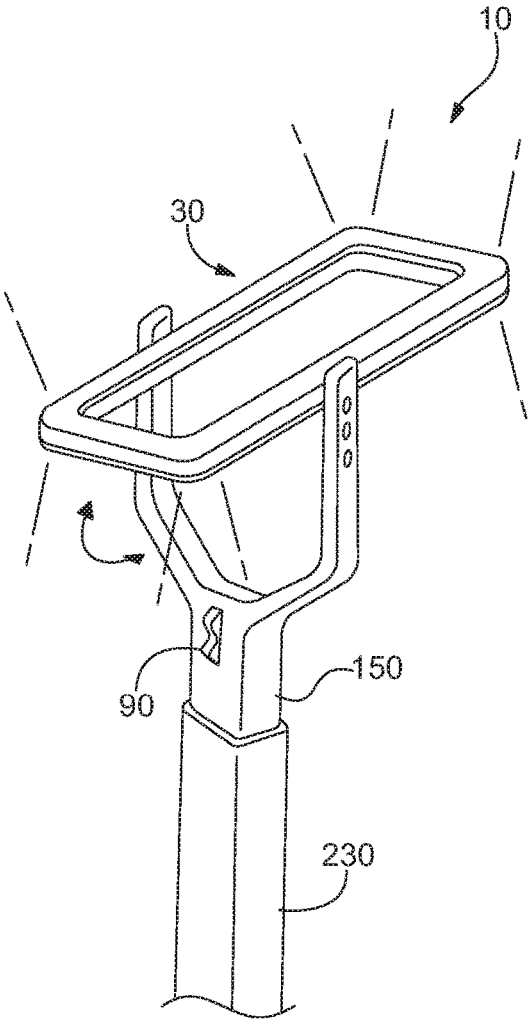
FIG. 15 is a partial exploded view of an exemplary embodiment of an apparatus with a pivoting handle portion of a lamp console.
Figure 16:
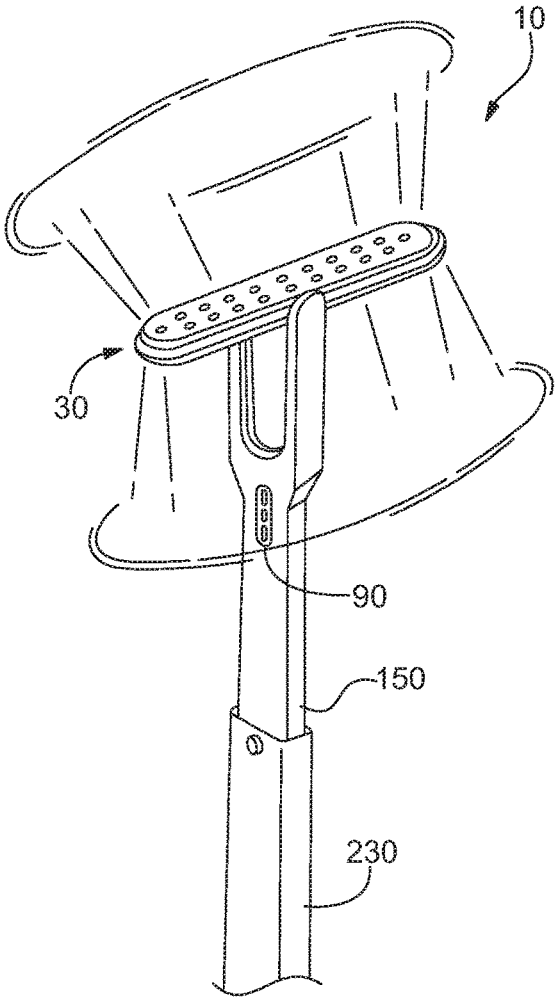
FIG. 16 is another partial exploded view of an exemplary embodiment of an apparatus with a pivoting lamp console; and, FIG. 17 is another partial exploded view of an exemplary embodiment of an apparatus with a pivoting lamp console.
Figure 17:
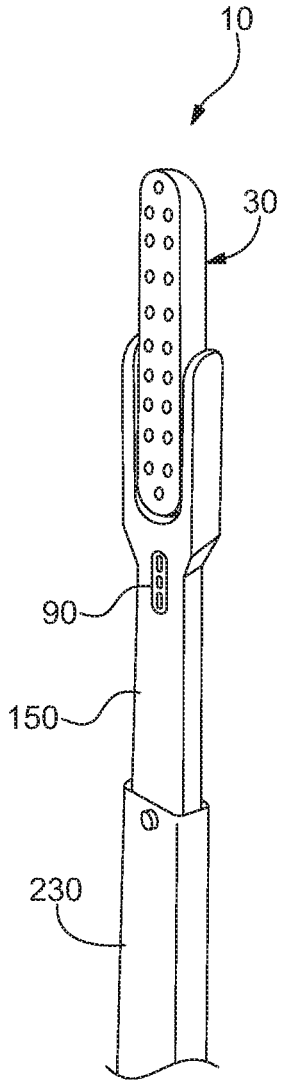

In an exemplary embodiment, a lamp console 30 and/or first illumination display 160 may be configured to rotate, extend, pivot, extend, and/or retract to provide a shelf 260 upon which items may be placed. A locking mechanism may be utilized to secure a lamp console 30 and/or first illumination display 160 in a desired position. In this embodiment, an apparatus 10 may also be used as an end table or support stand in addition to a cleaning device and lamp. Exemplary embodiments thereof are shown in FIGS. 12 and 13.

In an exemplary embodiment, an upright body portion 230, a handle 40, or a cleaning assembly 50 of an apparatus 10 may also be configured to provide a shelf 260 upon which items may be placed. This may be achieved by, for example, configuring an upright body portion 230, a handle 40, or a cleaning assembly 50 housing to adjust in height/length. This may be achieved by, for example, via a telescoping engagement. A portion of an upright body portion 230, a handle 40, and/or a cleaning assembly 50 may be provided with a planar member that acts as a shelf 260. In this embodiment, an apparatus 10 may also be used as an end table or support stand with a height-adjusting table-top in addition to a cleaning device and lamp. Exemplary embodiments thereof are shown in FIGS. 12 and 13.

The present disclosure may reference a constituent part in singular, but it is understood that a plurality thereof may be utilized and that any description of singulars is done for the sake of ease of illustration and brevity. It is understood that the same reference may include the singular or plurality of that constituent part without deviating from the teachings of a disclosed apparatus 10.

It will be apparent to those skilled in the art that numerous modifications and variations of the described examples and embodiments are possible in light of the above teachings of the disclosure. The disclosed examples and embodiments are presented for purposes of illustration only. Other alternate embodiments may include some or all of the features disclosed herein. Therefore, it is the intent to cover all such modifications and alternate embodiments as may come within the true scope of this disclosure, which is to be given the full breadth thereof. Additionally, the disclosure of a range of values is a disclosure of every numerical value within that range.

I claim:

1. A cleaning and illumination apparatus, comprising:

at least one cleaning device, said cleaning device having a cleaning assembly with at least one of a housing, a handle, and a base, the cleaning assembly configured to clean a cleaning surface;

at least one cleaning assembly coupler disposed on said at least one cleaning device, said at least one cleaning assembly coupler connected to and extending from the at least one of a housing, a handle, and a base of said cleaning assembly such that air does not flow through said cleaning assembly coupler during operation of said at least one cleaning device, said at least one cleaning assembly having electrical contacts;

a power cord and electrical wiring configured to transmit electrical power from an ancillary power supply to said apparatus;

at least one lamp console, each lamp console comprising:

at least one illumination display, each configured to emanate light from at least one removably attached illumination source; and, at least one coupler appendage disposed on said at least one illumination display, each coupler appendage having electrical contacts configured to engage said electrical contacts in said at least one cleaning assembly coupler, said at least one coupler appendage configured to releasably attach said at least one lamp console to said at least one cleaning assembly coupler such that electricity passing through said power cord travels through said electrical contacts in said at least one lamp console for illuminating said at least one illumination display;

at least one motor disposed on said cleaning device and/or lamp console and operatively associated with said cleaning assembly;

wherein said at least one illumination display can be illuminated when said at least one coupler appendage is connected to said at least one cleaning assembly coupler, and said at least one motor and said at least one cleaning device are operable when said at least one lamp console is connected or removed from said at least one cleaning assembly coupler.

2. The cleaning and illumination apparatus recited in claim 1, wherein said cleaning assembly coupler is configured as a tension knob/screw assembly.

3. The cleaning and illumination apparatus recited in claim 1, wherein:

said at least one handle is pivotally affixed to said cleaning assembly by a hub assembly having a first electrical contact plate and a second electrical contact plate, each of said first and second electrical contact plate configured to enable said electrical power transfer between each other while facilitating rotational motion of said hub assembly;

said hub assembly is provided with a locking mechanism to selectively retain said at least one handle in a desired position; and, said first electrical contact plate is in electrical communication with said power cord, and said second electrical contact plate is in electrical communication with said at least one cleaning assembly coupler.

4. The cleaning and illumination apparatus recited in claim 1, wherein:

said at least one cleaning device is provided with a first rechargeable battery configured to selectively receive and store said electrical power from said power cord, and selectively supply said electrical power to said electrical components of said apparatus;

said at least one lamp console is provided with a second rechargeable battery configured to selectively receive and store said electrical power from said power cord, and to selectively supply said electrical power to said at least one lamp console even when said at least one lamp console is disconnected from said at least one cleaning assembly coupler; and, said at least one lamp console is provided with a charging port enabling electrical connection to an ancillary charging station.

5. The cleaning and illumination apparatus recited in claim 1, wherein:

a coupler mechanism provides said temporary electromechanical communication between said at least one coupler appendage and said at least one cleaning assembly coupler; and, said coupler mechanism of a first lamp console is similar to said coupler mechanism of at least a second lamp console.

6. The cleaning and illumination apparatus recited in claim 1, wherein said at least one lamp console is configured to be a handle-extension to said at least one cleaning device.

7. The cleaning and illumination apparatus recited in claim 1, further comprising at least one lamp shade clip configured to removably attach to said at least one lamp console and support at least one ancillary lamp shade when affixed thereto.

8. The cleaning and illumination apparatus recited in claim 1, further comprising at least one cap configured to removably cover and protect said at least one cleaning assembly coupler when said at least one lamp console is disconnected from said at least one cleaning assembly coupler.

9. The cleaning and illumination apparatus recited in claim 1, wherein said at least one cleaning device comprises an upright cleaning device, said base having a cleaning surface, said upright cleaning device having an upright body extending between said base and said handle.

10. The cleaning and illumination apparatus recited in claim 9, wherein said upright cleaning device is provided with an upright cleaning device motor.

11. The cleaning and illumination apparatus recited in claim 1, wherein said lamp console is provided with said cleaning assembly.

12. A cleaning and illumination apparatus, comprising:

at least one cleaning device, said cleaning device having a cleaning assembly configured to clean a cleaning surface;

at least one cleaning assembly coupler disposed on said at least one cleaning device, said at least one cleaning assembly having electrical contacts;

a power cord and electrical wiring configured to transmit electrical power from an ancillary power supply to said apparatus;

at least one lamp console, each lamp console comprising:

at least one first illumination display, each configured to emanate light from at least one removably attached first illumination source; and, at least one coupler appendage disposed on said at least one first illumination display, each coupler appendage having electrical contacts configured to engage said electrical contacts in said at least one cleaning assembly coupler, said at least one coupler appendage configured to releasably attach said at least one lamp console to said at least one cleaning assembly coupler such that electricity passing through said power cord travels through said electrical contacts in said at least one lamp console for illuminating said at least one first illumination display;

at least one second illumination display disposed on said cleaning device, wherein:

said at least one second illumination display is configured to emanate light from at least one removably attached second illumination source; and, said at least one second illumination display is provided with at least one illumination display shade, each illumination display shade configured to encase said at least one second illumination display and/or at least a portion of said at least one cleaning device;

at least one motor disposed on said cleaning device and/or lamp console and operatively associated with said cleaning assembly;

wherein said at least one first and second illumination displays can be illuminated when said at least one coupler appendage is connected to said at least one cleaning assembly coupler, and said at least one motor, said at least one second illumination display, and said at least one cleaning device are operable when said at least one lamp console is connected or removed from said at least one cleaning assembly coupler.

13. The cleaning and illumination apparatus recited in claim 12, further comprising at least one handle.

14. The cleaning and illumination apparatus recited in claim 12, wherein:

said at least one handle is pivotally affixed to said cleaning assembly by a hub assembly having a first electrical contact plate and a second electrical contact plate, each of said first and second electrical contact plate configured to enable said electrical power transfer between each other while facilitating rotational motion of said hub assembly;

said hub assembly is provided with a locking mechanism to selectively retain said at least one handle in a desired position; and, said first electrical contact plate is in electrical communication with said power cord, and said second electrical contact plate is in electrical communication with said at least one cleaning assembly coupler.

15. The cleaning and illumination apparatus recited in claim 12, wherein:

said at least one cleaning device is provided with a first rechargeable battery configured to selectively receive and store said electrical power from said power cord, and selectively supply said electrical power to said electrical components of said apparatus;

said at least one lamp console is provided with a second rechargeable battery configured to selectively receive and store said electrical power from said power cord, and to selectively supply said electrical power to said at least one lamp console even when said at least one lamp console is disconnected from said at least one cleaning assembly coupler; and, said at least one lamp console is provided with a charging port enabling electrical connection to an ancillary charging station.

16. The cleaning and illumination apparatus recited in claim 12, wherein:

a coupler mechanism provides said temporary electromechanical communication between said at least one coupler appendage and said at least one cleaning assembly coupler; and, said coupler mechanism of a first lamp console is similar to said coupler mechanism of at least a second lamp console.

17. The cleaning and illumination apparatus recited in claim 12, wherein said at least one lamp console is configured to be a handle-extension to said at least one cleaning device.

18. The cleaning and illumination apparatus recited in claim 12, further comprising at least one lamp shade clip configured to removably attach to said at least one lamp console and support at least one ancillary lamp shade when affixed thereto.

19. The cleaning and illumination apparatus recited in claim 12, further comprising at least one cap configured to removably cover and protect said at least one cleaning assembly coupler when said at least one lamp console is disconnected from said at least one cleaning assembly coupler.

20. The cleaning and illumination apparatus recited in claim 12, wherein said at least one cleaning device comprises an upright cleaning device, said upright cleaning device having a base with a cleaning surface, said upright cleaning device having at least one upright cleaning device handle and an upright body extending between said base and said at least one upright cleaning device handle.

21. The cleaning and illumination apparatus recited in claim 20, wherein said upright cleaning device is provided with an upright cleaning device motor.

22. The cleaning and illumination apparatus recited in claim 12, wherein said lamp console is provided with said cleaning assembly.

* * * * *